US005717771A

United States Patent [19]

Sauer et al.

[11] Patent Number: 5,717,771

[45] Date of Patent: Feb. 10, 1998

[54] PROGRAMMABLE HEARING AID MEANS WORN IN THE AUDITORY CANAL

[75] Inventors: Joseph Sauer, Strullendorf; Christof Haertl, Neunkirchen; Hans-Joachim Weiss, Nuernberg, all of Germany

[73] Assignee: Siemens Audiologische Technik GmbH, Erlangen, Germany

[21] Appl. No.: 609,560

[22] Filed: Mar. 1, 1996

[30] Foreign Application Priority Data

Mar. 1, 1995 [DE] Germany ..... 195 07 168.9
Jun. 28, 1995 [DE] Germany ..... 195 23 552.5

[51] Int. Cl.[6] ..... H04R 25/00

[52] U.S. Cl. ..... 381/68.6; 381/68; 381/69

[58] Field of Search ..... 381/68.6, 68, 68.7, 381/69, 25, 183, 187

[56] References Cited

U.S. PATENT DOCUMENTS 4,830,139 5/1989 Cirillo .
4,918,737 4/1990 Luethi .
5,012,520 4/1991 Steeger .
5,295,191 3/1994 Van Vroenhoven ..... 381/68.6

FOREIGN PATENT DOCUMENTS 0 176 116 4/1986 European Pat. Off. .
0 341 902 11/1989 European Pat. Off. .
3431584 3/1986 Germany .
88 00 629.8 6/1989 Germany .
92 13 343.6 3/1993 Germany .
673551 3/1990 Switzerland .

*Primary Examiner*—Sinh Tran
*Attorney, Agent, or Firm*—Hill, Steadman & Simpson

[57] ABSTRACT

For data exchange with a programmable hearing aid worn in the auditory canal, an electrical line is provided that contains leads in electrical contact with a circuit in the hearing aid and which is mechanically attached to the hearing aid so as to serve as an extractor for the hearing aid. The free end of the electrical line carries a signal receptor, such as a plug or socket or a wireless receiver with a gripping surface.

19 Claims, 2 Drawing Sheets

FIG 3

FIG 2

FIG. 1A
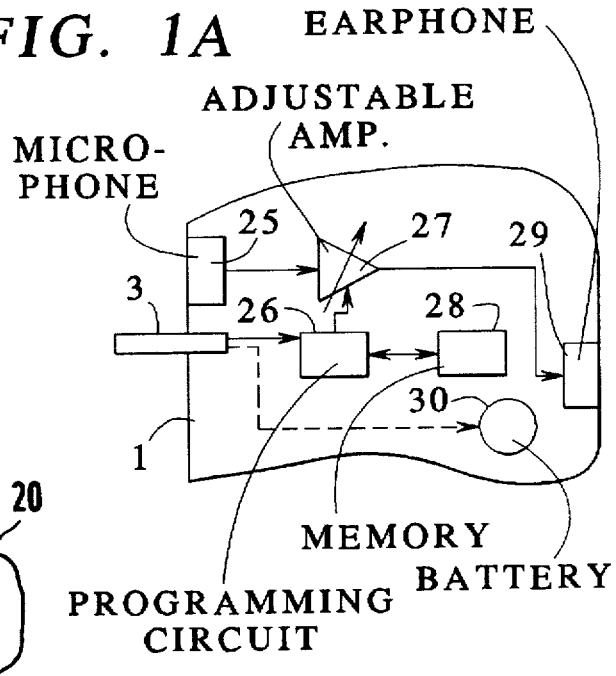
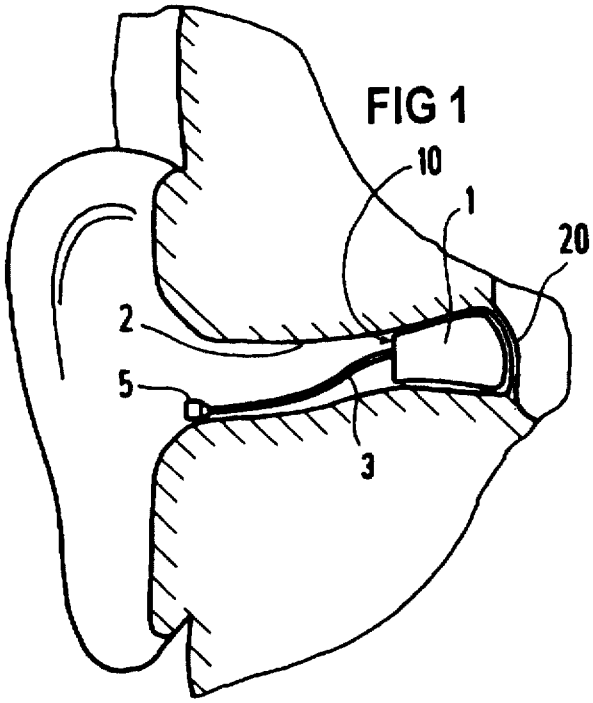
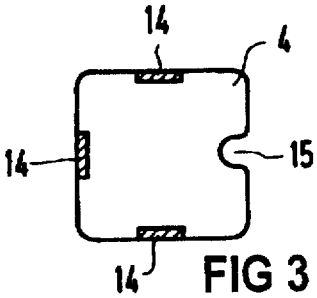
FIG 3
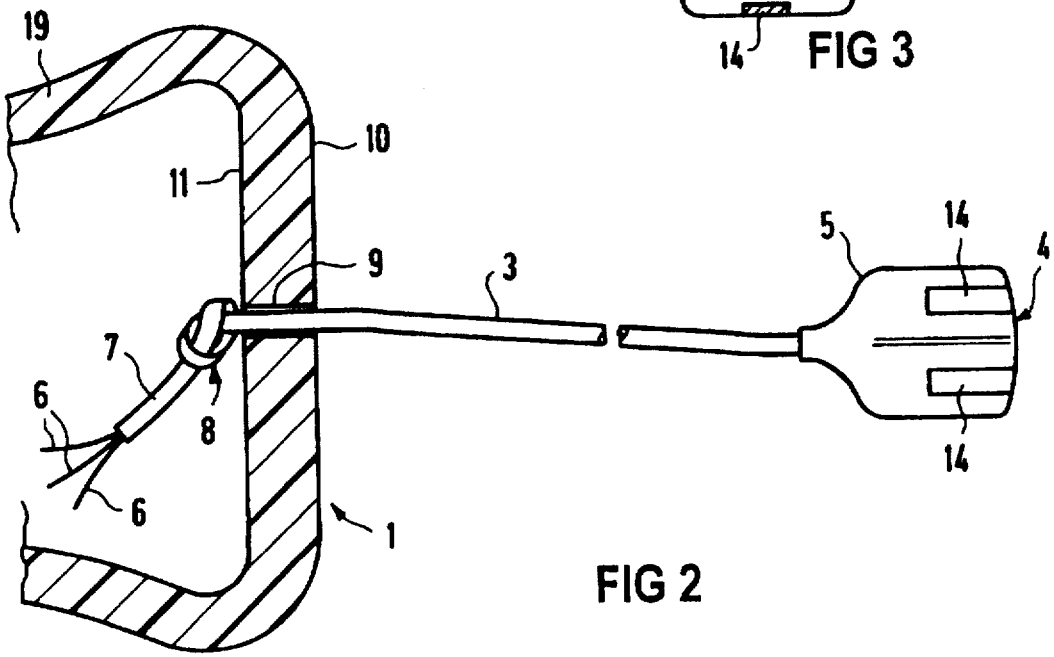
FIG 2

PROGRAMMABLE HEARING AID MEANS WORN IN THE AUDITORY CANAL

BACKGROUND OF THE INVENTION

1. Field of the Invention

The present invention is directed to a programmable hearing aid of the type worn in the auditory canal, with an extraction means for taking the hearing aid out of the auditory canal.

2. Description of the Prior Art

From German Utility Model 8800629.8, a behind-the-ear (BTE) hearing aid is known which contains a programmable circuit connectable to an external data generation source for the purpose of providing setting data. For this purpose the known hearing aid has a socket part having electrical terminal sockets, which are conductively connected to a printed circuit board of the programming circuit and which are connectable to the external data generation source by means of mating electrical plugging pins of a plug part. Although this approach is satisfactory for a hearing aid which is of the size of a BTE heating aid, in smaller heating aids, in particular hearing aids that are worn largely in the auditory canal, no space is available for additional programming sockets or for sockets for receiving programming connectors.

European Application 341 902 and Swiss Patent 673 551 disclose programmable heating aids and devices for making electrical contact to the hearing aids from an external hearing aid programming system, wherein the programmable hearing aid contains a programming circuit, a programming terminal coupled to the programming circuit, and a battery chamber having battery terminals connected with the programming circuit. The device for electrical contacting is a coupling element having a positive electrode, a negative electrode and a programming electrode, whereby the programming electrode is electrically connectable with the external hearing aid programming system and the coupling element is suited for bringing the battery terminals into contact with the positive and negative electrode and for bringing the programming terminals into contact with the programming electrode. The coupling element is dimensioned so as to fit in the battery chamber, so that when the coupling element is arranged therein, the positive and the negative electrode are in electrical contact with the battery terminals and the programming electrode is in contact with the programming terminal in the battery chamber.

In order to be able to withdraw a hearing aid out of the auditory canal that is situated deep in the auditory canal when in use, extraction means fastened to the hearing aid are used, for example extraction wires (U.S. Pat. No. 4,830,139) or plastic threads (German Utility Model 9213343). In order to make extraction means of this sort more easily graspable, it is known to provide the ends of such extraction means with thicker areas as a fastening means and to distribute individual plastic beads at intervals along the length of the thread as a gripping means.

SUMMARY OF THE INVENTION

An object of the present invention is to solve, in a simple and space-saving fashion, the problems of controllability removal from the auditory canal which occur with small programmable hearing aids that are externally not visible or are barely visible because they are worn deep in the auditory canal.

For this purpose, in the hearing aid according to the invention an electrical line is provided that is contacted in an electrically conductive manner with a circuit contained inside the housing or shell of the hearing aid and at the same time is mechanically attached to the hearing aid housing or shell, and its free end terminates in a signal receptor element having a gripping surface. In one embodiment, the signal receptor can be a socket part and the electrical line can thereby form a programming line contacted with a programming circuit in the hearing aid. This solution has the advantage that a programming socket on the housing of the hearing aid itself is avoided, because the already present extraction means serves at the same time for the programming. In an advantageous design of the invention, the signal receptor of the extractor means has a gripping surface. Without requiring a removal of the current source and thus an associated interruption of the power supply of the hearing aid, the hearing aid according to the invention is capable of being coupled to an external data unit, a programming means or a personal computer (PC) for the exchange of data. Moreover, a current source, e.g. a battery, in the hearing aid means can be charged via the programming line.

According to another embodiment, for a remotely controllable hearing aid a gripping element of the extraction means contains a wireless receiver that receives the control signals from a transmitter remote from and unconnected to the hearing aid, the received signals being supplied to a signal processing device of the hearing aid.

According to exemplary embodiments, the wireless receiver can, e.g. an antenna, an infrared diode for the reception of infrared control signals or an acoustic transducer for the reception of ultrasound waves.

If a microphone is provided in the gripping element for the reception of ultrasound control signals, this has the advantage of permitting the microphone of the hearing aid which is used for hearing improvement also to be usable for the purpose of control signal reception, and it can then be situated outside the housing of the hearing aid, which is of small construction, thereby permitting the hearing aid housing to be made even smaller.

For a remotely controllable, wireless, programmable hearing aid, in a further embodiment of the invention the receptor in the gripping element of the electrical line of the hearing aid is also usable for the reception of the programming data, so that the receptor replaces further electrical connection means on the handle, such as for example a plug or socket.

According to another embodiment of the invention a transmitter is provided in the gripping element of the electrical line of the hearing aid, via which data from the hearing aid can be called.

DESCRIPTION OF THE DRAWINGS

FIG. 1 schematically illustrates a hearing aid constructed in accordance with the principles of the present invention, worn deep in the auditory canal, having an extraction means that forming an electrical line for the transmission of data between an external data unit and the hearing aid.

FIG. 1A schematically illustrates some of the basic components in the hearing aid of FIG. 1.

FIG. 2, in enlarged partial section, shows a housing shell segment of the face plate of the hearing aid of FIG. 1 the face plate having a bored hole for the introduction of a programming line, with the free end of the programming line having an electrical connection means which also forms a gripping element.

FIG. 3 is an enlarged top view of the electrical connection means of FIGS. 1 and 2.

DESCRIPTION OF THE PREFERRED EMBODIMENTS

Figure 4:
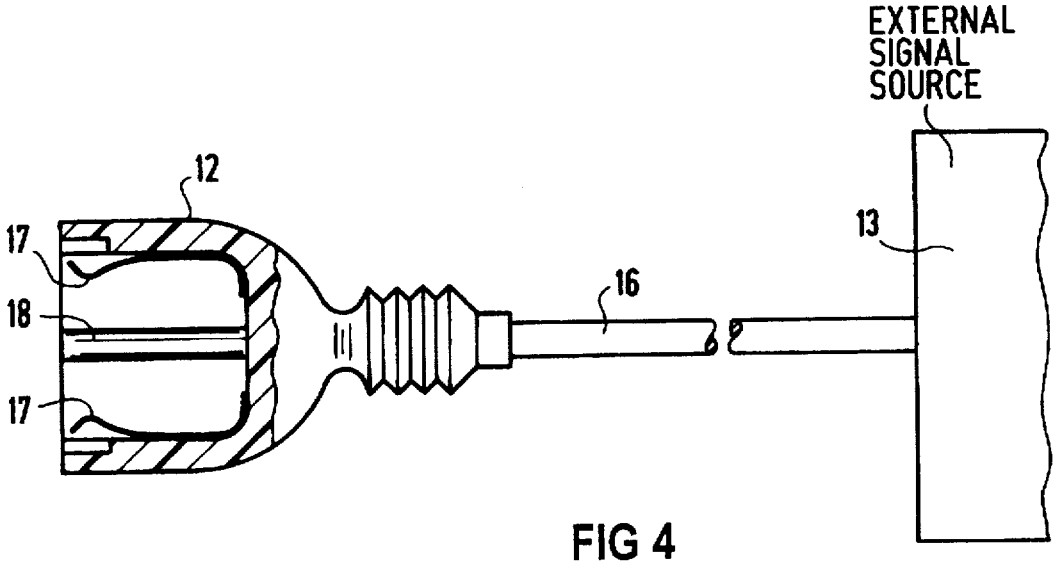
FIG. 4 an adapter of a cable connection to an external programming means, charging means, or the like, which mates with the electrical connection means of FIGS. 1, 2 and 3.

The hearing aid 1, which can be placed deep in the auditory canal 2, conventionally contains in its housing basic components (shown, in FIG. 1A such as a microphone 25, an electronic amplifier stage with a programming circuit 26, an adjustable amplifier 27 and a programmable memory 28, an earphone 29 and a power source such as a battery 30 (connections between the battery 30 and the components powered thereby being standard and well-known and thus being omitted from FIG. 1A. The housing of the hearing aid 1 consists principally of a housing shell 19, closed on the side facing away from the eardrum 20 by means of a face plate 10.

Since in hearing aids of such small size as the hearing aid 1 there is barely any room for the arrangement of a programming socket in the face plate 10, according to the invention an electrical line 3 is provided, e.g. a programming line to the programming circuit 26 of the hearing aid 1. By this means it is also possible for the hearing aid 1 to remain in the ear of the user during the fitting process, making the fitting of the hearing aid 1 (adjustment to the shape of the middle/inner ear of the user) considerably easier. In order to withdraw the small hearing aid 1, worn deep in the auditory canal, from the auditory canal, an extraction means is necessary. According to the invention, the electrical (programming) line 3 simultaneously forms such an extraction means, since the electrical leads 6 of the line 3 are contacted with the programming a circuit 26 of the hearing aid 1 in an electrically conductive fashion, and the line 3 is mechanically attached to the hearing aid 1.

As an example, the line 3 can be fed into the interior of the housing through a bored hole 9 in the face plate 10, and a tension securing structure 8 is provided. According to FIG. 2, the programming line 3 can be knotted to form a tension securing structure 8. Dependent on the nature and position of the jacket of insulating material 7 of the line 3, sealing of the bored hole 9 can ensue by means of the jacket 7. An additional sealing is possible by means of the arrangement of the tension securing structure 8 on the housing inner wall 11 of the face plate 10.

The free end of the programming line 3 of the hearing aid 1 has an electrical receptor element 4, e.g. a socket or a plug connector, that can be coupled with a mating adapter 12 of an external signal source 13, of a data unit, such as a programmer, a personal computer, or the like for the purpose of data exchange. If, for the supply of energy in the hearing aid 1, a chargeable power source, e.g. the battery 30, is provided, the programming line 3 can also be used for charging the power source of the hearing aid 1 (as described in FIG. 1A) and can, for example, be connected to a charging source as the external signal source 13.

As FIG. 4 shows schematically, the programming source 13 is electrically connectable with the receptor element 4 of the programming line 3 of the hearing aid 1 via a cable 16 and the adapter 12. For this purpose, in the receptor element 4 connection contacts 14 are provided, and in the adapter 12 counter-contacts 17 are provided. Additionally, the parts to be connected can slide and stop means 15 e.g. in the form of a groove is and an arrest rib 18. So that the programming line 3 for withdrawal of the hearing aid 1 from the auditory canal 2 can be easily grasped, the receptor element 4 has an appropriately shaped gripping surface 5.

FIGS. 3 and 4 respectively show the signal receptor 4 as a plug and the adaptor 12 as a socket, however, these elements can easily be reversed.

Figure 5:
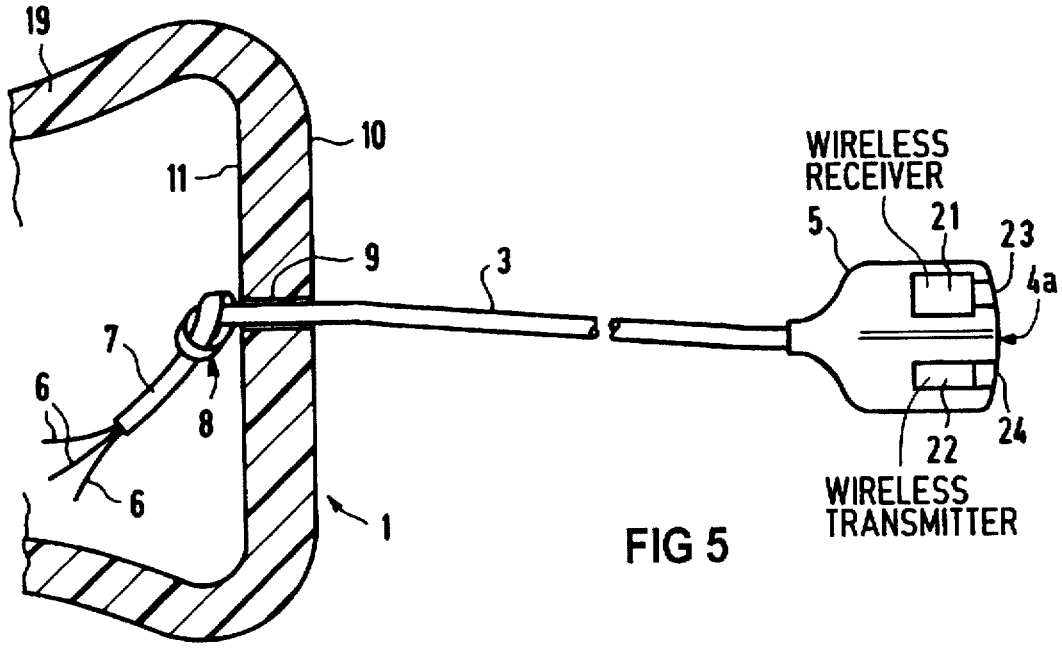
FIG. 5, in enlarged partial section, shows a housing shell segment of a further embodiment of a hearing aid constructed in accordance with the principles of the present invention, with the face plate having a bored hole for the introduction of the electrical line, and the free end of this line a gripping element carrying a receiver and or a transmitter.

As is shown schematically in the exemplary embodiment of FIG. 5, signal receptor 4a has the gripping surface 5 thereon and carries a wireless receiver 21 for control signals and/or usable sound signals, as well as a wireless transmitter 22 for data output. In an advantageous embodiment, a microphone is provided as the receiver 21, with an associated sound inlet opening 23, which can receive speech and ambient acoustic signals as well as ultrasound control signals. Such a microphone 25 can replace the microphone of the actual hearing aid 1 normally present for hearing assistance. The reference number 24 designates a signal outlet opening of the transmitter 22. The wireless receiver 21 and transmitter 22 can alternatively operate by reception/transmission of infrared signals or radio signals. The receiver 21 and transmitter 22 are powered by the battery 30 contained in the hearing aid 1 via a supply line conducted in the programming line 3.

Although modifications and changes may be suggested by those skilled in the art, it is the intention of the inventors to embody within the patent warranted hereon all changes and modifications as reasonably and properly come within the scope of their contribution to the art.

We claim as our invention:

1. A programmable hearing aid comprising:

a hearing aid housing having a size and shape adapted for wear in a human auditory canal containing electrical components including a programmable amplifier, circuit; and extraction means for withdrawing said hearing aid from the auditory canal comprising an electrical lead containing a plurality of electrical conductors in direct electrical contact with at least some of said electrical components in said hearing aid and mechanically attached to said housing, said electrical lead having a free end at which a signal receptor having a gripping surface is disposed, said electrical lead comprising an electrical programming line having an electrical conductor in direct electrical connection with said programmable amplifier circuit.

2. A hearing aid as claimed in claim 1 wherein said programming line comprises a jacket of insulating material and further comprising a tension securing structure attaching said programming line to said housing.

3. A hearing aid as claimed in claim 2 wherein said housing comprises a face plate having a hole therein through which said programming line extends, and wherein said tension securing structure acts against said face plate.

4. A hearing aid as claimed in claim 3 wherein said programming line seals said hole.

5. A hearing aid as claimed in claim 3 wherein said tension securing structure comprises a thickened region of said programming line disposed in said housing against said face plate at said hole.

6. A hearing aid as claimed in claim 5 wherein said thickened region of said programming line comprises a knot in said programming line.

7. A hearing aid as claimed in claim 1 wherein said signal receptor comprises a wireless receiver for wirelessly receiving control signals from a remote wireless transmitter.

8. A hearing aid as claimed in claim 7 wherein said wireless receiver comprises a radio receiver.

9. A hearing aid as claimed in claim 7 wherein said wireless receiver comprises an infrared diode for receiving infrared signals.

10. A hearing aid as claimed in claim 11 wherein said microphone for receiving ultrasound signals comprises as microphone connected to said electrical components in said housing of said hearing aid for receiving audio signals.

11. A hearing aid as claimed in claim 7 wherein said wireless receiver comprises a microphone for receiving ultrasound signals.

12. A hearing aid as claimed in claim 1 wherein said signal receptor comprises a wireless receiver for receiving programming signals from a remote programmer and wherein said wireless receiver comprises the only means for said hearing aid receiving said programming signals.

13. A hearing aid as claimed in claim 1 wherein said signal receptor comprises a wireless receiver contained in a gripping element on which said gripping surface is disposed, and further comprising a wireless transmitter contained in said gripping element and electrically connected via said electrical line to at least some of said electrical components in said housing for remotely transmitting data therefrom.

14. A programmable hearing aid comprising:

a hearing aid housing having a size and shape adapted for wear internally within a human auditory canal and containing electrical components;

a signal receptor having a gripping surface;

extraction means for withdrawing said hearing aid from the auditory canal comprising an electrical lead containing a plurality of electrical conductors in direct contact with at least some of said electrical components in said hearing aid and mechanically attached to said housing, said electrical lead having a free end at which said signal receptor is disposed and a length so that said signal receptor is disposed at an opening of the auditory canal when said housing is internally within the auditory canal; and an external signal source having a cable terminating in a signal transmitter mechanically and electrically mating with said signal receptor.

15. A hearing aid as claimed in claim 14 wherein said signal receptor comprises an electrical socket and wherein said gripping surface is disposed on an exterior of said electrical socket.

16. A hearing aid as claimed in claim 14 wherein said electrical components in said housing of said hearing aid include a power source, and wherein said signal source comprises means for recharging said power source through said electrical lead.

17. A programmable hearing aid comprising:

a hearing aid housing having a size and shape adapted for wear internally within a human auditory canal and containing electrical components;

a signal receptor comprising a wireless receiver for wirelessly receiving control signals from a remote wireless transmitter, said signal receptor having a gripping surface; and extraction means for withdrawing said hearing aid from the auditory canal comprising an electrical lead containing a plurality of electrical conductors in direct contact with at least some of electrical components in said hearing aid and mechanically attached to said housing, said electrical lead having a free end at which said signal receptor is disposed and a length so that said signal receptor is disposed at an opening of the auditory canal when said housing is internally within the auditory canal.

18. A programmable hearing aid comprising:

a hearing aid housing having a size and shape adapted for wear in a human auditory canal and containing electrical components including at least one programmable electrical component;

a signal receptor comprising a wireless receiver for receiving programming signals from a remote programmer, said wireless receiver comprising the only means for said hearing aid receiving said programming signals, said signal receptor having a gripping surface; and extraction means for withdrawing said hearing aid from the auditory canal comprising an electrical lead containing a plurality of electrical conductors including at least one electrical conductor in direct contact with said at least one programmable electrical component for supplying said programmable signals from said wireless receiver to said at least one programmable electrical component, said electrical lead being mechanically attached to said housing and having a free end at which said signal receptor is disposed.

19. A programmable hearing aid comprising:

a hearing aid housing having a size and shape adapted for wear in a human auditory canal and containing a plurality of electrical components including at least one programmable electrical component and at least one data-emitting electrical component;

a gripping element having a gripping surface thereon;

a wireless receiver contained in said gripping element for receiving programming signals from a remote programmer;

a wireless transmitter contained in said gripping element for remotely transmitting data emitted by said data-emitting electrical component; and extraction means for withdrawing said hearing aid from the auditory canal comprising an electrical lead containing a plurality of electrical conductors, including two electrical conductors respectively connecting said wireless receiver to said programmable electrical component and connecting said wireless transmitter to said data-emitting electrical component, said electrical lead being mechanically attached to said housing and having a free end at which said gripping element is disposed.

* * * * *